United States Patent [19]

Greven

[11] 4,301,700

[45] Nov. 24, 1981

[54] CUTTING APPARATUS

[75] Inventor: Richard Greven, Escondido, Calif.

[73] Assignee: Unicel Corporation, Escondido, Calif.

[21] Appl. No.: 129,086

[22] Filed: Mar. 10, 1980

[51] Int. Cl.[3] ..... B26D 5/32; B26D 5/34

[52] U.S. Cl. ..... 83/91; 83/157; 83/210; 83/268; 83/387; 83/422; 83/444; 83/450

[58] Field of Search ..... 83/458, 449, 444, 383, 83/209, 210, 249, 252, 367, 422, 386, 387, 155, 157, 268, 91

[56] References Cited

U.S. PATENT DOCUMENTS

| | | | |
|---|---|---|---|
| 1,560,452 | 11/1925 | Wielandt | 83/209 X |
| 1,567,078 | 12/1925 | Pennington | 83/387 |
| 1,852,534 | 4/1932 | Moore | 83/450 X |
| 2,130,729 | 9/1938 | Burns | 83/209 X |
| 2,838,113 | 6/1958 | Cornell | 83/209 |
| 3,037,412 | 6/1962 | Sarka | 83/387 X |
| 3,400,622 | 9/1968 | Olsen | 83/210 |
| 3,420,128 | 1/1969 | Russell | 83/449 X |
| 3,731,571 | 5/1973 | Larson et al. | 83/449 X |
| 3,842,699 | 10/1974 | Zyl | 83/151 |

*Primary Examiner*—Frank T. Yost

*Attorney, Agent, or Firm*—Stephen E. Feldman; Marvin Feldman

[57] ABSTRACT

A cutting apparatus for cutting a web into sheets comprises a web shear. A web stop is disposed downstream of the shear. A web feed is disposed upstream of the web shear. A web stiffening device is disposed between the web shear and the web stop for holding the web in a rigid flat plane whereby the web is repeatedly cut to the same desired length.

13 Claims, 6 Drawing Figures

FIG. 5
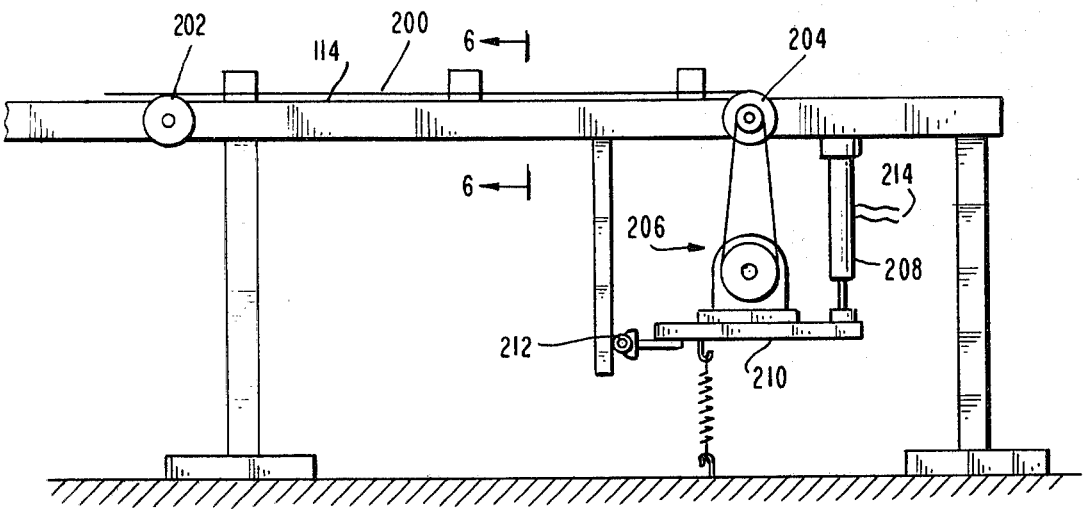
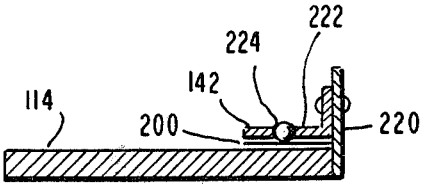
FIG. 6

CUTTING APPARATUS

BACKGROUND OF THE INVENTION

While the invention is subject to a wide range of applications, it is particularly suited for cutting sheets of very accurate length from long strips of metal or other material.

In cutting very thin sheets of continuous web which may include metal or paper, it is often necessary to very accruately repeat the same length of sheet during each cut. For instance, in the formation of honeycomb, a continuous web may be printed with glue lines as described in our co-pending U.S. patent application Ser. No. 56,462 filed on July 11, 1979. When the sheets are stacked on top of one another and joined together by heat and pressure, it is extremely important that the glue lines are properly lined up in order that the honeycomb is finished with cells of the same shape and in the proper location. Thus, the very thin material used in the construction of the honeycomb material, such as for example aluminum having a thickness of 0.0015 to 0.004 inches must be cut to a set length which is accurately established and maintained during the cutting process.

In the past, it has been known to cut sheets of material to an accurate length. For example, U.S. Pat. No. 2,637,394 to Fey, discloses for example, "A method for close tolerance cutting of sheets which the portion of a strip from which the sheet is being cut is bowed across its width and thereby made rigid so that the portion of the strip extending between two predetermined points will be a fixed length." This reference relies on the bowing of the strip across its width in order to stiffen the material to provide accurate cutting.

In the operation of a shear cutter, it is important that the web be fed at an appropriate time as well as the cutting device being operative when required. In U.S. Pat. No. 2,890,750 to Depken, there is disclosed for example, "The entrance of a continuous or elongated metal strip into a shearing machine changes the magnetic state of an electromagnetic sensing device to establish an electrical control signal. After a suitable time dealy to insure correct positioning of the incoming strip, the electrical control signal energizes suitable devices to start the successive shearing of the elongated strip into separate individual strips for lamentations." This reference is significantly different from the present invention because it is not concerned with the accurate cutting of very thin strips of web material.

It is an object of the present invention to provide an improved cutting apparatus for close tolerance cutting of sheets from a strip of web material.

It is a further object of the present invention to provide a cutting apparatus which holds the web in a rigid flat plane in order to accurately cut the web material.

It is a still further object of the present invention to provide a cutting apparatus which automatically feeds the strip of web material and cuts it into sheets of very accurate length.

It is a still further ojbect of the present invention to provide a cutting apparatus which senses the webs and disengages the feeding mechanism and activates a web shear.

SUMMARY OF THE INVENTION

Accordingly, there has been provided a cutting apparatus for cutting a web into sheets comprising a web shear. A web stop is disposed downstream of the shear.

A web feed is disposed upstream of the web shear. A web stiffening device is disposed between the web shear and the web stop for holding the web in a rigid flat plane whereby the web is repeatedly cut to the same desired length.

For a better understanding of the present invention, taken with other and further objects thereof, reference is had to the following description taken in connection with the accompanying drawings, while its scope will be pointed out in the appended claims.

BRIEF DESCRIPTION OF THE DRAWINGS

FIG. 5 is a side view of a second embodiment of a cutting table; and

FIG. 6 is a view through 6—6 of FIG. 5.

DESCRIPTION OF THE PREFERRED EMBODIMENT OF THE INVENTION

Figure 1:
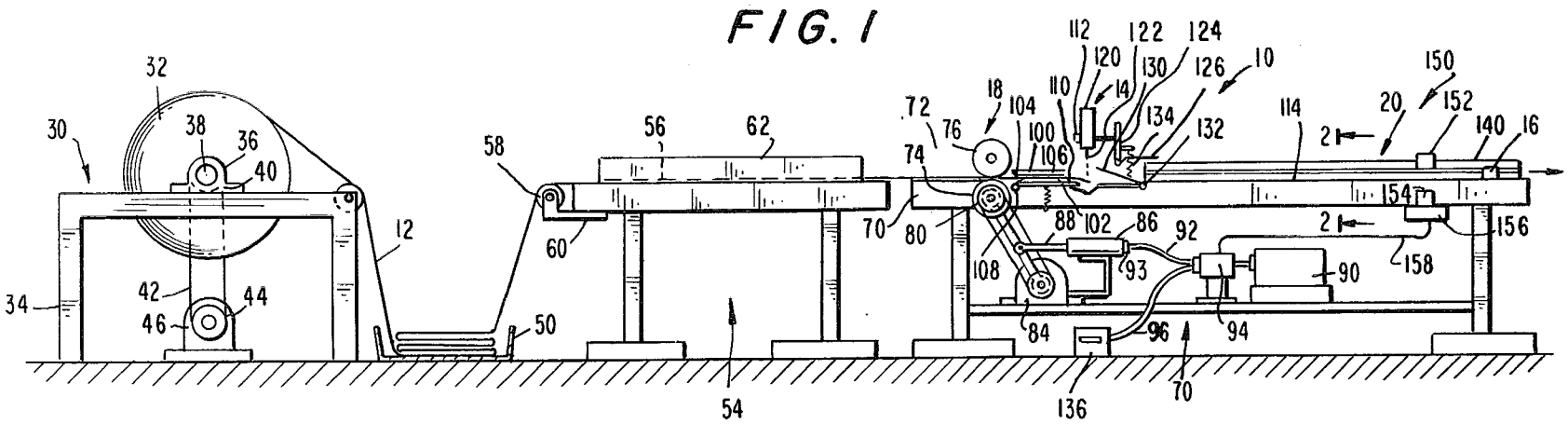
FIG. 1 is a side view of a cutting apparatus in accordance with the present invention.
Figure 4:
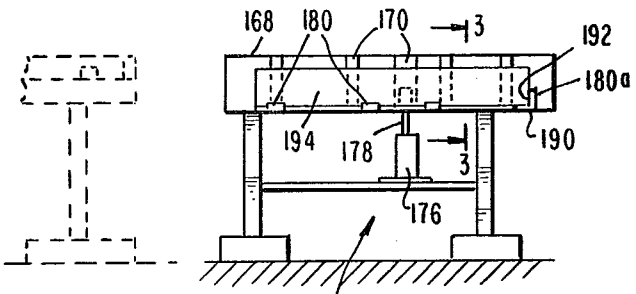
FIG. 4 is a side view of a stacking table.

A cutting apparatus 10 for cutting a web 12 into sheets comprises a web shear 14. A web stop 16 is disposed downstream of the web shear 14. A web feed 18 is disposed upstream of the web shear 14. A web stiffening device 20 is disposed between the web shear and the web stop for holding the web in a rigid flat plane whereby the web is accurately cut to a desired length.

Referring to FIG. 1, there is shown a cutting apparatus 10 for cutting web 12 into sheets. An unwind stand 30 is provided to feed web rolled on a reel 32 preferably at a constant speed. The unwind stand 30 includes a base support structure 34 which may be of any conventional shape. Two bearing devices 36 (only one is illustrated) supports a reel shaft 38 about which the reel 32 rotates. A pulley 40 is attached to the reel shaft 38 and carries a belt 42. Belt 42 may be turned by a pulley 44 which is operated by a motor 46. The motor is preferably a conventional electrically powered variable speed motor. The actual speed of the motor can be controlled by a device such as a rheostat (not shown) so that the web can be taken off of the reel at a speed such as approximately 50 feet/minute. It is also within the scope of the preferred embodiment of the invention to take the web directly from a web printing apparatus of the type disclosed in the co-pending patent application Ser. No. 56,462, filed July 11, 1979.

A pan 50 is disposed downstream from the unwind stand 30 so that the web which unrolls from the reel 32 is held in the event that it is not directly used or required further downstream as will be further described. The invention also contemplates the use of any other conventional means for keeping the web from becoming tangled in the event that more is unwound from the reel than is required during a very short periof of time.

An alignment table 54 is located downstream from the unwind stand 30 and receives the web as it moves towards the web shear 14. The alignment table 54 includes a flat alignment surface 56 which is flat and may be formed of any desired smooth material, such as for example, formica. An alignment roller 58 is affixed to the alignment table by a bracket 60. The roller 58 is preferably made of a metal such as for example, aluminum. The roller 58 reduces any friction formed on the web as the latter passes onto the alignment surface.

Parallel guide edges 62 and 64 are affixed along the length of the alignment surface and spaced apart the width of the web which is passing through the apparatus 10. Either one or both of the guide edges is preferably adjustable so that the distance between the edges 62 and 64 can be adjusted according to the width of the web which is passed across the alignment table.

The purpose of the alignment table 54 is to align the direction of movement of the web through the apparatus downstream from the table. An important consideration is that the alignment is provided without any tension on the web. In the case where tension is present on the web, the pressure is transferred to the dried glue lines which may be printed on the web material. When a pressure or tension is produced, the glue lines may peel off of the web material and prevent proper binding when the strips of web material are fixed together.

A web cutting table 70 is disposed adjacent to and downstream from the alignment table 54. A web feed device 72 includes a drive roller 74 and a follower roller 76 for frictionally gripping the web and pushing the web past the web shear 14. The lower roller 74 may have a rubber coating and is set in the table 70 so that it is slightly above the surface 78 of the cutting table 70. The follower roller 76 may be covered with rubber and rest against the drive roller 74 to create the friction for moving the web through the web feed device.

The drive roller has a pulley 80 on one end which carries a belt 82. The belt may be driven by a variable speed motor 84 at any desirable speed. Motor 84 is supported by a base plate 85 which is pivotally connected by a hinge device 87 to a fixed support such as beam 89. A spring device 91 biases the plate 85 downward. A conventional air actuated cylinder 86 is connected between base plate 85 and table 70. Extending the rod 88 by actuation of cylinder 86 takes up the slack in belt 82 and causes the pulley 80 to rotate. Drawing the rod into cylinder 86 stops the rotation of pulley 80.

The control of the distance which rod 88 travels is an advantageous feature of the present invention. The cylinder in conjunction with the spring 91 changes the slack and alters the tension on the belt 82. When the slack is removed and the tension is strong, the pulley 80 turns and causes the feed device to push the web downstream. Conversely, when slack is present, the feed device does not push the web downstream. Sometimes the web has to be moved by hand slightly downstream towards the web stop 16. Since the drive rollers are frictionally holding the web this slight movement may be difficult. To overcome this problem, the cylinder is adjusted to provide a slight tension on the belt 82 that is insufficient to independently rotate roller 74, but enough whereby the belt 82 rotates drive roller 74 in conjunction with the manual movement of the web.

The air actuated cylinder 86 is connected to a conventional high pressure air supply 90 by an air line 92. A solenoid valve 94 is provided in the air line 92 to open and close the line in response to a sensing device as described below. A conventional air regulator 93 is located between the valve 94 and the cylinder 86.

Two parallel plates 100 and 102 are disposed adjacent the upstream side of the web shear 14 and act to flatten the web prior to its crossing of the shear. The plate 100 is an upper fixed plate having a bottom surface 104 which is preferably very smooth and may be covered with a material such as formica. The plate 102 is a lower movable plate having a top surface 106 which presses the web against the bottom surface of the fixed plate 100. The top surface is positioned slightly above a downstream surface 114 on web stiffening device 20. The top surface 106 is also very smooth and may have a formica surface. The lower movable plate 102 is pivotably secured at its upstream edge 108 so that the web shear 14 can push the downstream edge 110 of the lower plate downward as the shear cuts the web. The movement of the plate 102 prevents tension in the web during the cutting of the web. A conventional coil spring 111 may be set under the plate 102 to bias it back to its normal position parallel to the upper plate 100. The lower plate is pushed down by an element 112 that is fixed to the web shear 14 as will be explained below.

The parallel plates 100 and 102 provide several functions. With the lower plate 102 positioned slightly above the downstream stiffening surface 114, any curl formed at the edge of the web after the cut does to catch on the shear structure and inhibit the movement of the web downstream past the shear. More specifically, the curl usually faces downward and may have a tendency to be caught in an indentation 116 which receives the edge of the shear 14. The parallel plates also flatten and stiffen the web to help its movement downstream. Further, the lower plate 102 pivots downward as the shear 14 cuts the web to substantially elminate any tension which might be created on the web during the cutting process.

The web shear 14 may be a conventional shear cutter including a blade 120 with a knife edge 122. As previously mentioned, an element 112 is affixed to the blade 120 to engage the downstream edge 110 of the plate 102. An arm 124 is connected to the blade 120 and includes a resilient rubber edge 126 affixed to its lower end. The arm may be mounted so that the rubber edge 126 remains parallel to the surface 114 throughout the movement of the blade 120. In addition, the length of the arm 124 may be approximately the width of the surface 114.

A hinge plate 130 is pivotally connected at the corners 132 of its downstream edge. A spring device such as coil spring 134 is connected between the arm 124 and the hinge plate 130. The web shear 14 is preferably actuated by a foot switch 136 that is connected to the solenoid valve 94 by an air line 96. In operation, as the shear 14 descends to cut web, the arm 124 pushes the hinge plate 130 downward. Just prior to the shearing of the web, the hinge plate is clamped downward by the arm 124 so that the web cannot move during the shearing process. Later when the shear and the arm 124 moves to an upward position, the coil spring 134 draws the plate to a opened position as shown. When the hinge plate is in open position, it acts to guide the web which is slightly above the surface 114 down to the surface.

Figure 2:
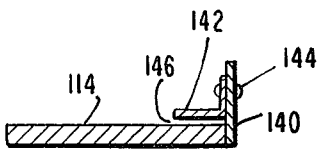
FIG. 2 is a view through 2—2 of FIG. 1.

A web stiffening device 20 is disposed between the web shear 14 and a web stop 16 to hold the web in a rigid flat plane whereby the web is accurately cut to a desired length. The stiffening device includes a flat bottom stiffening surface 114 which supports the web as it moves downstream. This surface is preferably very smooth and may be covered with a material such as formica. A support element 140 as best seen in FIG. 2 is bonded to the side of the stiffening surface 114 along its length. A strip of material 142 such as an L-shaped angle is attached to the support element by any desired means such as rivets 144. The strip 142 has a flat top surface 146 disposed above the bottom stiffening surface so that the web is held flat as it slides between the bottom and top surfaces 114 and 146, respectively. As with the other surfaces on which the web moves, the flat top surface 146 is preferably smooth and may be covered with a smooth material such as formica.

A web stiffening device is a very important aspect of present invention in that it changes a normally flexible web to a web that is stiff and rigid along its length. The rigidity is created when the web is held in a rigid flat plane. Note that the support element 140 does not necessarily engage the web as the latter moves downsteam. The alignment of the table 54 controls the direction of movement of the web and thereby eliminates the need for the side elements to align the web.

A sensing device 150 is disposed between the shear 14 and the web stop 16. The sensing device 150 may be a conventional electric eye which passes a light beam between two elements 152 and 154. In addition, a conventional timing device 156 is connected to the sensing device 150 whereby various functions are performed at specified times. An electric line 158 is connected between the timing device and the solenoid valve 94. As the web passes under the sensing device 150, a signal is sent to the timing device 156. After a predetermined amount of time, device 156 signals the solenoid valve to open and cause the web feed device 18 to stop pushing the web downstream. The timing device allows the web feeding device to continue pushing the web in the time period after the web is sensed by device 150 but before or just as it reaches the web stop 16. In addition, the timing device opens valve 94, and permits operation of the web shear 14 by foot control 136. Although a photoelectric device is preferred, it is within the scope of the present invention to use any other suitable sensing device such as for example, an electromagnetic sensing device.

A web stop 16 is disposed downstream from the sensing device 150. The web stop may be a small bar material which can be affixed to the stiffening surface 114 whenever desired.

Figure 3:
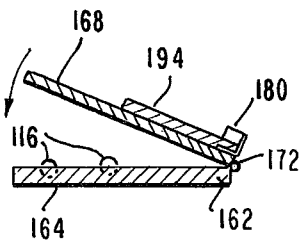
FIG. 3 is a view through 3—3 of FIG. 1.

A stacking device 160 is disposed downstream from said web stop 16 and is used for stacking sheets of web after being cut by the web shear 14. The stacking device, as best seen in FIGS. 1 and 3 is comprised of a stacking table 162 which is basically a bottom support surface 164 having a plurality of casters 116 placed thereon. A top frame surface 168 may be formed by a rectangular external frame work with a plurality of cross members 170 extending between the longitudinal frame members. The top frame surface may be connected to the bottom support surface by a plurality of hinge devices 172.

A lift device 174 for lifting and lowering the top frame surface 168 may be provided and attached to a frame of the stacking table. The lifting device may be comprised of a hydraulic cylinder 176 which moves a rod 178 against a portion of the top frame surface such as a cross frame 170. In the normal position, the top frame surface is maintained at an approximate angle of 30 degrees to the bottom support surface. However, it is within the scope of the present invention to use any desirable angle as required.

Alignment members 180 are provided along the length of the frame surface 168 and extend up therefrom for supporting the edge of the web after it has been cut. An end element **180*a* may have two support surfaces so that the ends of the strips may be accurately aligned upon one another. A caul 194 which may be a rectangular sheet of material, such as aluminum, may be placed on the top frame surface with its edges against the edge support elements. The caul is used as a surface for the strips of web which are stacked on the stacking device 160. After the desired number of pieces of web have been stacked, the hydraulic cylinder lowers the top frame surface and the caul 194 is rolled off of the stacking device by the casters 116**.

In order to more fully understand the present invention, a description of its operation and advantages follow. In general, the cutting apparatus 10 is used to cut web material which is very thin and flexible. For example, the material may be aluminum having a range from 0.0015 to 0.004 inches. However, the machine is not limited to this size range. Also the machine is suitable for shearing paper. The ultimate purpose of the cutting apparatus is to cut sheets of web material to substantially the exact same length. The web usually begins as a continuous strip of material that has been printed with glue lines and ends up in an unexpanded laminate of sheets. After curing the adhesive, the laminate is expanded into a uniform cellular structure.

The cellular structure is formed by applying suitable adhesive lines of accurate width, spaced equally apart transversely, as the web is taken off of a coil. The continuous web, with the equally spaced glue lines, is then cut into equal sheets of such a length that when the sheets are stacked on top of one another, the glue line on the prior sheet is centered accurately between the glue lines on the next sheet. The adhesive is then cured and cuts are made transverse to the glue line to the desired thickness. The laminate is then expanded into a uniform cellular structure.

The accuracy of the alignment of the glue lines in the stack is essential to uniform formation of the cellular structure. Thus, the cutting operation is extremely critical because a uniform cellular structure can only be produced when the web is cut to a precise accurate length so that the adhesive lines align properly when stacked. The cutting apparatus 10 of the present invention performs this function as will be described below. A primary aspect of the invention is the web stiffening device which holds the web in a rigid flat plane between the web shear and the web stop so that the web can be accurately cut to a desired length.

A roll of web material 32 which was printed with glue lines is placed on unwind stand 30. The web is then threaded through the cutting apparatus so that the proper shear line is placed under knife edge 122. The web is unwound from the unwind stand 30 at a rate determined by motor 46, the pulleys and belts associated therewith. Usually the stand is adjusted so that the web comes off at approximately 50 feet/minute. The web may drop into a pan 50 if it is not being fed downsteam. As the web passes onto alignment table 54, it moves between the parallel guide edges 62 and 64, so that its direction of forward movement may be determined. The web then continues its movement downstream as it passes through the web feed device 18 where the drive roller and follower roller frictionally grips the web and pushes it downstream until it is sensed by the sensing device 150.

The web is able to be pushed because it is in a stiffened condition. It passes through a pair of parallel plates 100 disposed adjacent the upstream side of the shear to flatten the web just prior to the web crossing the shear.

The web continues to move down the web stiffening device. The web is held flat between stiffening surface 114 and top surface 146 as it slides toward the web stop 16. When the web passes the sensing device 150, it signals the timing device 156. Device 156 signals the valve 94 to open and stop the web feed 18 after the web either touches or almost touches the web stop 16. Valve 94 also activates foot control 136 whereby the machine operator can actuate the web shear whenever desired.

When the web is ready to be sheared, the operator looks to see if it has reached the stop 16. If it has not, the operator moves it by hand to contact the stop. Then the foot control is activated and the cutter descends to shears the web at the desired position. It is very desirable to shear material because this process does not remove any material in the cutting process. Thus the sheets of web are repeatedly produced with the same accurate length.

During the shearing, as the shear moves downward, arm 124 contacts the hinge plate 130 and clamps the web against the flat bottom surface to prevent movement of the web downstream of the shear during the cutting of the web. In addition, the element 112 contacts the downstream edge 110 of the parallel plate 102 and pivots it downward to relieve any tension that might be created on the web during the actual process. It should be noted that it is very important to relieve any tension to prevent the glue lines from peeling off. After the web is cut into a sheet, the shear 14 returns to a ready position. This allows plate 102 to spring back to a parallel position with plate 100 and the hinge plate 126 to be pulled back by arm 124.

During the normal use of the cutting apparatus, the web is cut perpendicular to its length. It is, however, within the scope of the present invention for the direction of movement of the sheet to be at any desired angle with respect to the shear. In this instance, the alignment table would align the direction of movement of the web. In addition, the web stiffening device would be adjusted to accomodate the web moving towards the web stop.

After the web is cut, the operator takes it and places it on the stacking device 160. It may be placed with the longitudinal edge against edge support elements 180 and the end against the support surface 192. When a desired number of strips of web have been cut and placed on the stacking device, the hydraulic cylinder may lower the top frame surface so that the caul can be rolled off and taken to a desirable location.

A second embodiment of the cutting table is illustrated in FIGS. 5 and 6. In the event that extremely thin web material is used, it may be difficult to feed the web downstream. The second embodiment includes a conventional conveyor belt 200 which is operated across the surface 114 of cutting table 70. This belt may pass over rollers 202 and 204. The roller 204 is driven by a conventional power drive device 206 including a motor, pulley and belt. The drive device 206 is activated by an air actuated cylinder 208 in substantially the same manner as in the drive for power roller 74 in FIG. 1. The platform 210 is pivoted up and down about pivot point 212 in response to air pressure in cylinder 208. The air pressure may be delivered to an airline 214 from the solenoid valve 94 when air is delivered to web feed 18, described above. Thus, the conveyor is designed to move and carry the web downstream during the period of time that web feed 18 is feeding the web onto the cutting table.

Another feature of the second embodiment resides in the web stiffening which performs a similar function to device 20 of the first embodiment. A support element 220 holds a plurality of devices 222 which may be formed from L-shaped angle material above surface 114. A hole 224 is provided in each device 222. A ball 224, such as a ball bearing, is carried in each hole 224 and extends downward to contact the conveyor belt. When a web is carried down the conveyor 200, the balls 224 hold the web in a rigid flat plane.

It can now be seen by one skilled in the art that there has been provided a cutting apparatus for close tolerance cutting of sheets of strip of web material, for holding the material in a rigid flat plane to accuratey cut the material, to automatically feed the strip of web material and to sense the web whereby it disengages the feeding mechanism and actuates a web shear.

While there has been described what is at present considered to be the preferred embodiment of the invention it will be obvious to those skilled in the art that various changes and modifications may be made therein without departing from the invention, and it is, therefore, aimed in the appended claims to cover all such changes and modifications as fall within the true spirit and scope of the invention.

What is claimed is:

1. A cutting apparatus for cutting a web into sheets comprising:
   (a) web shear means,
   (b) web stop means disposed downstream of said shear means,
   (c) web feed means disposed upstream of said web shear means,
   (d) web stiffening means disposed between said web shear means and said web stop means for holding the web in a rigid flat plane whereby the web is accurately cut to a desired length, wherein said web stiffening means includes a flat bottom stiffening surface for supporting the web and a flat top surface disposed above said bottom stiffening surface to hold the web flat as it slides between the bottom and top surfaces, and hinge plate means disposed downstream of and adjacent said web shear means for clamping the web against said flat bottom surface and for preventing any movement of the web downstream of the shear means during the cutting of the web.

2. The cutting apparatus of claim 1 wherein arm means are operatively associated with said shear for pressing the hinge plate against the flat bottom surface prior to the cutting of the web.

3. The cutting apparatus of claim 1 wherein alignment means are disposed upstream of said shear means for aligning the direction of movement of the web.

4. The cutting apparatus of claim 3 wherein said alignment means includes a flat alignment surface for supporting the web and parallel guide edges spaced apart the width of the web to align the direction of the web.

5. The cutting apparatus of claim 1 wherein said web feed means includes a drive roller and a follower roller for frictionally gripping the web and pushing the web past the shear means.

6. The cutting apparatus of claim 5 wherein sensing means are disposed between said shear means and said stop means and are operatively connected to said web feed means for activating the web feed means to push the web towards the stop means when the absence of the web is sensed and to stop the web feed means from pushing the web in response to the presence of the web.

7. The cutting apparatus of claim 6 wherein sensing means are connected to said shear means for enabling said shear means to operate when the presence of said web is sensed.

8. The cutting apparatus of claim 1 further comprising parallel plate means disposed adjacent the upstream side of the shear to flatten the web just prior to the web crossing said shear means.

9. The cutting apparatus of claim 8 wherein said parallel plates means includes an upper fixed plate having a bottom surface engaging the web and a lower movable plate having a top surface pressing the web against the fixed plate.

10. The cutting apparatus of claim 9 wherein said lower movable plate is pivotally secured so that the web shear means pushes the downstream edge of the lower plate downward to prevent tension on the web during the cutting of the web.

11. The cutting apparatus of claim 1 wherein stacking means are disposed downstream of said web stop means for stacking the sheets of web which are cut by said web shear means.

12. The cutting apparatus of claim 1 wherein the web stiffening means includes ball elements for holding the web.

13. The cutting apparatus of claim 12 wherein the web stiffening means includes conveyor means for carrying the web downstream.

* * * * *